US006715544B2

(12) United States Patent
Gillespie et al.

(10) Patent No.: US 6,715,544 B2
(45) Date of Patent: Apr. 6, 2004

(54) WELL SCREEN

(75) Inventors: George A. Gillespie, Coon Rapids, MN (US); David Bruxelle, Chauvigny (FR); Christophe Malbrel, Poitiers (FR); Phong Vu, The Woodlands, TX (US); Michael William Neal, Bellmere (AU)

(73) Assignee: Weatherford/Lamb, Inc., Houston, TX (US)

( * ) Notice: Subject to any disclaimer, the term of this patent is extended or adjusted under 35 U.S.C. 154(b) by 36 days.

(21) Appl. No.: 09/961,788

(22) Filed: Sep. 24, 2001

(65) Prior Publication Data

US 2002/0038707 A1 Apr. 4, 2002

Related U.S. Application Data

(60) Provisional application No. 60/236,668, filed on Sep. 29, 2000.

(51) Int. Cl.[7] ..... E21B 43/08
(52) U.S. Cl. ..... 166/230; 166/233
(58) Field of Search ..... 166/230, 236, 166/234, 235, 50, 227, 233

(56) References Cited

U.S. PATENT DOCUMENTS

| | | | |
|---|---|---|---|
| 2,388,640 | A | 11/1945 | Moore et al. |
| 3,709,293 | A | 1/1973 | Layne, II et al. |
| 3,712,373 | A | 1/1973 | Bearden et al. |
| 3,816,894 | A | 6/1974 | Howard et al. |
| 3,908,256 | A | 9/1975 | Smith, III |
| 3,958,634 | A | 5/1976 | Smith, III |
| 4,204,967 | A | 5/1980 | Bannister |
| RE31,604 | E | 6/1984 | Bearden et al. |
| 4,526,230 | A | 7/1985 | Kojicic |
| 4,583,594 | A | 4/1986 | Kojicic |
| 4,649,996 | A | 3/1987 | Kojicic et al. |
| 4,818,403 | A | 4/1989 | Nagaoka |
| 5,004,049 | A | 4/1991 | Arterbury |
| 5,311,942 | A | 5/1994 | Nagaoka |
| 5,355,948 | A | 10/1994 | Sparlin et al. |
| 5,624,560 | A | 4/1997 | Voll et al. |
| 5,642,781 | A | 7/1997 | Richard |
| 5,785,122 | A | 7/1998 | Spray |
| 5,823,260 | A | 10/1998 | McConnell et al. |
| 5,881,809 | A | 3/1999 | Gillespie et al. |
| 5,937,944 | A | 8/1999 | Simone et al. |
| 5,979,551 | A | 11/1999 | Uban et al. |
| 6,089,316 | A | 7/2000 | Spray |
| 6,158,507 | A | 12/2000 | Rouse et al. |

FOREIGN PATENT DOCUMENTS

WO WO 01/51766 A1 7/2001

OTHER PUBLICATIONS

EXCLUDER2000 Well Screen; Sand Control Technologies; May 2000; Baker Hughes Incorporated, Houston Texas.
PoroPlus! The Newest Name In Sand Control Screens; Halliburton.
Stratapac and Stratacoil Screens, Because Sand is Not Uniform.; Pall Corporation.
The EXCLUDER; The Extended Longevity Well Screen; Baker Hughes Incorporated INTEQ; Aug. 1995.
EQUALIZER Production Management System; Baker Hughes Incorporated, Baker Oil Tools; Houston, Texas; Mar. 2000.

*Primary Examiner*—Frank Tsay
(74) *Attorney, Agent, or Firm*—Moser, Patterson & Sheridan, L.L.P.

(57) ABSTRACT

A well screen (10) comprising a wire (14) spirally wrapped around a perforated base pipe (12) and spacing the perforated base pipe from a woven wire mesh filtering medium (16).

6 Claims, 4 Drawing Sheets

WELL SCREEN

CROSS-REFERENCE TO RELATED APPLICATIONS

This application claims priority under 35 U.S.C. §119 to provisional patent application No. 60/236,668 filed Sep. 29, 2000.

BACKGROUND AND SUMMARY OF THE INVENTION

The present invention relates to filtering screens, and particularly to well screens which filter particulate matter out of a fluid as it is drawn from a well. More particularly, the present invention relates to well screens used to filter sand out of oil or gas as it is being drawn from a well.

A typical oil or gas well includes a "string" which extracts oil from the well. The string generally constitutes a tube which provides a pathway to the Earth's surface for subterranean oil or gas. The string typically includes a plurality of casing or joint assemblies positioned along the string in the oil or gas bearing portions of the formation being drilled. A casing or joint assembly portion typically includes a perforated base pipe through which oil and gas can flow. In this way, oil or gas enters the string and is drawn to the Earth's surface.

However, because oil and gas producing wells are often drilled through unconsolidated formations, such as sandstone, the oil or gas must be filtered before flowing through the perforated base pipe and entering the string. Therefore, the casing or joint assembly typically includes one or more screen segments covering the perforated base pipe, so particulate matter in the oil or gas will be removed from the fluid before it enters the string. The existence of sand in the fluid being produced (e.g., oil, gas, water, etc.) is undesirable because it causes extra wear and abrasion on production tubing, valves, pumps, and other equipment used to produce fluids from wells.

Thus, a typical casing or joint assembly includes a perforated base pipe with one or more screen segments wrapped around it. The perforated base pipe and screen assembly is in turn encased in an outer, perforated jacket which protects the screens from damage as the string is lowered into the formation.

Plugging or clogging of the screen or screens around the perforated base pipe can severely decrease the production of the well. In conventional casing or joint assemblies, if that portion of the well screen directly over a particular base pipe perforation becomes completely clogged, no further oil or gas can flow through that perforation and it is rendered useless. As portions of the screen above particular base pipe perforations become clogged, the number of base pipe perforations through which oil can flow is severely decreased and the production of the well correspondingly goes down. Moreover, as the screen becomes clogged, the flow rate through unclogged portions increases causing increased wear and tear on those portions.

A casing or joint assembly which maximizes the usefulness of every perforation in the base pipe, even when portions of the well screen are clogged, would be welcomed by those in the oil, gas and other fluid producing industries.

According to the present invention, an oil well casing includes a filtering medium separated from a perforated base pipe by a spacer. The spacer is positioned to lie between the perforated base pipe and the filtering medium to space the filtering medium from the base pipe. The spacer forms a channel or channels between the filtering medium and the perforated base pipe connecting multiple base pipe perforations. In this way, fluid passing through a given portion of the filtering medium is permitted to subsequently flow through an aperture in the perforated base pipe which is not necessarily aligned with that portion of the filtering medium through which the fluid has just passed. In other words, according to the present invention, if a portion of the filtering medium directly above a given base pipe perforation is clogged, the base pipe perforation is still useful because fluid flowing through other, unclogged, portions of the filtering medium may travel via the channel or channels to the perforation.

In preferred embodiments, the spacer includes a spirally-wrapped wire and the filtering medium includes a wire-mesh screen. Consecutive turns of the spirally-wrapped wire create a channel between the wire-mesh screen and the perforated base pipe. The channel may have a width approximately equal to the diameter of the perforations in the base pipe and provides a connection between the various perforations.

Additional features and advantages will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
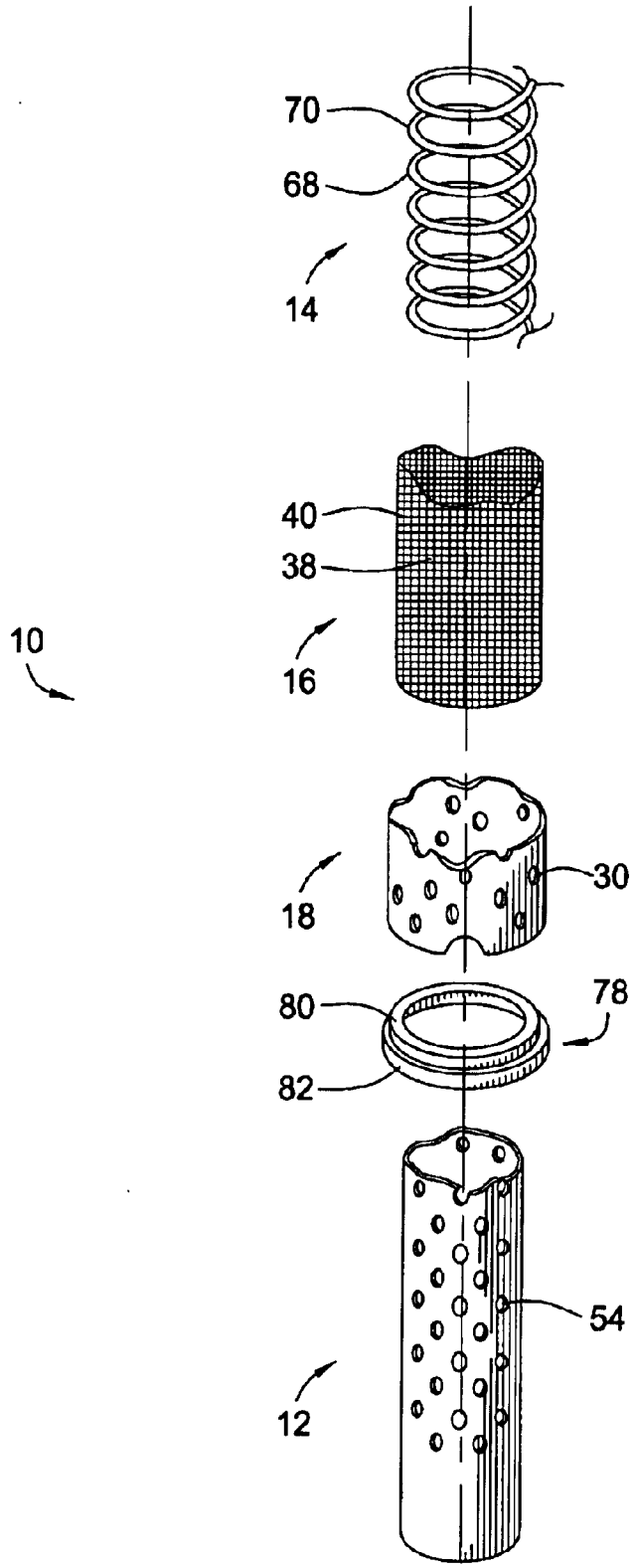
FIG. 1 is an exploded perspective view of a portion of a well screen in accordance with the present invention including a perforated base pipe, a spirally-wrapped wire, a wire-mesh screen, a protective outer jacket, and a connection ring.

As shown in FIGS. 1–4, a well screen 10 in accordance with the present invention includes a perforated base pipe 12, a spirally-wrapped wire 14, a wire-mesh screen 16, and a perforated jacket 18. The spirally-wrapped wire 14 is positioned between the wire-mesh screen 16 and the perforated base pipe 12. The spirally-wrapped wire 14 thereby creates a first annular space 20 between the wire-mesh screen 16 and the perforated base pipe 12. However, it will be readily apparent to one of ordinary skill in the art that other spacer members (e.g., longitudinal ribs, longitudinally-spaced rings, etc., not shown) may be used to space the wire-mesh screen 16 from the perforated base pipe 12. The spacer member may include a relatively course woven wire mesh which has a relatively high open area (e.g. 10% or greater) as compared to the filtering wire-mesh screen 16. In this way, the relatively course woven wire mesh spaces and supports the wire-mesh screen 16 from the perforated base pipe 12 creating a drainage layer there between in a manner similar to the spirally-wrapped wire 14. Similarly, the spacer member may include a combination of the above-described elements. For example, the spacer member may include longitudinal ribs surrounded by a spirally-wrapped wire spot welded to the longitudinal ribs at those points where the spirally-wrapped wire and longitudinal ribs intersect. Again, this provides a drainage and support layer for the wire-mesh screen 16.

Additionally, although the spirally-wrapped wire 14 spaces the wire-mesh screen 16 from the perforated base pipe 12, it will be readily apparent to one of ordinary skill in the art that the spirally-wrapped wire 14 may space other filtering media (e.g., wire-wrap screens, etc., not shown) from the perforated base pipe 12. The perforated jacket 18 encases the wire-mesh screen 16 and is spaced apart from the wire-mesh screen 16 to create a second annular space 22.

The well screen 10 includes threaded portions (not shown) on the base pipe 12 at each end so that the well screen 10 may be connected to other string sections (not shown). For example, the well screen 10 may be produced in 4 foot sections. Therefore, if a well is drilled through an 8 foot region of oil, two 4 foot well screens 10 may be interconnected in the region to maximize the flow rate of oil out of the region. If the well bore includes regions devoid of oil, straight, unperforated, sections of pipe may interconnect multiple well screens 10, so that a well screen 10 is not wasted in a barren region.

Similarly, it may be desired to weld multiple wire-mesh screens 16 together to create a filtering medium of a sufficient length to match the length of a particular base pipe 12. For example, if it is desired to surround a 12 foot perforated base pipe with 4 foot cylindrical sections of wire-mesh screen, three sections of wire-mesh screen must be welded end-to-end. To do this, consecutive revolutions 68 and 70 of the spirally-wrapped wire 14 are positioned particularly close together or are "tightened up" at those points where two cylindrical sections of the wire-mesh screen 16 are welded. Positioning consecutive revolutions 68 and 70 of the spirally-wrapped wire 14 close together creates a foundation against which the joint between the two sections of the wire-mesh screen 16 can be welded. In other segments of the spirally-wrapped wire 14, the consecutive revolutions are sufficiently spaced to provide good drainage behind the wire-mesh screen 16.

Figure 4:
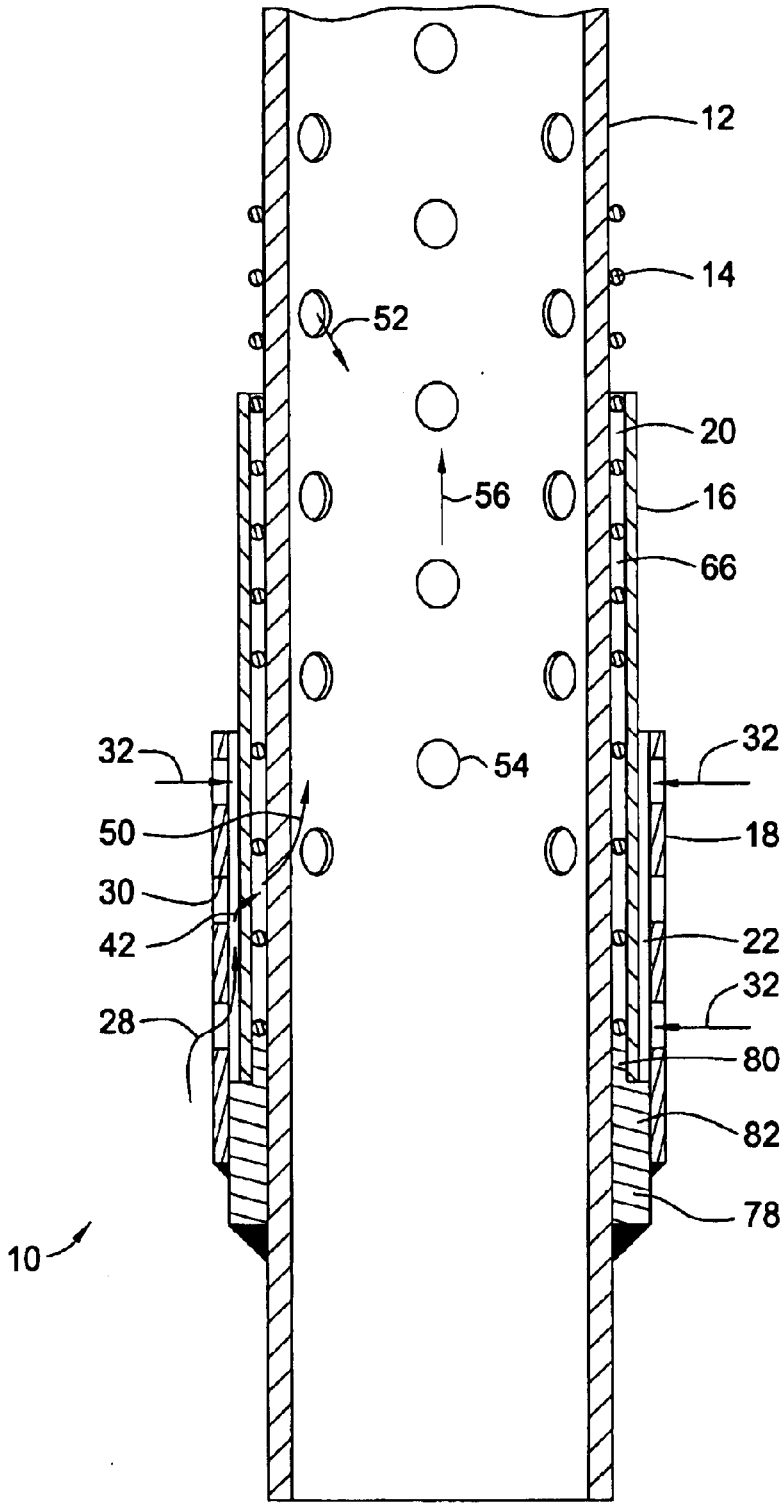
FIG. 4 is a sectional view of the portion of the well screen of FIG. 1 taken along line 4—4 of FIG. 3.

As shown in FIG. 4, oil (or any other fluid being extracted from a well, such as gas, water, etc.) flows along a path 28 from outside perforated jacket 18 to the second annular space 22 inside perforated jacket 18. The oil (not shown) flows into the second annular space 22 through any one of a number of circular perforations 30 formed in perforated jacket 18. The circular perforations 30 are preferably ¼ of an inch in diameter and define outer passageways 32 through which the oil flows. Formation sand (not shown) carried by the oil flows through the outer passageways 32 and into the second annular space 22.

Once the oil is in the second annular space 22, it is forced through the wire-mesh screen 16. As can best be seen with reference to FIG. 4, the oil is forced through the wiremesh screen 16, and cannot flow around it, because the wire-mesh screen 16 is welded (and thus sealed) to a lower plateau 80 of a connection ring 78, which is in turn coupled to the perforated base pipe 12. Similarly, the perforated jacket 18 is welded to an upper plateau 82 of the connection ring 78. Thus, the perforated jacket 18 and the wire-mesh screen 16 are welded to the connection ring 78 at different locations. In this way, if the jacket 18 "hangs up" on an obstruction in the well bore during insertion into the well bore, the torque placed on the jacket 18 will be transmitted to, and absorbed by, the connection ring 78 and the base pipe 12 and will not be transmitted to the wire-mesh screen 16. The base pipe 16 is preferably the strongest component of the well screen 10 and can handle a substantial torque significantly better than the wire-mesh screen 16.

Figure 2:
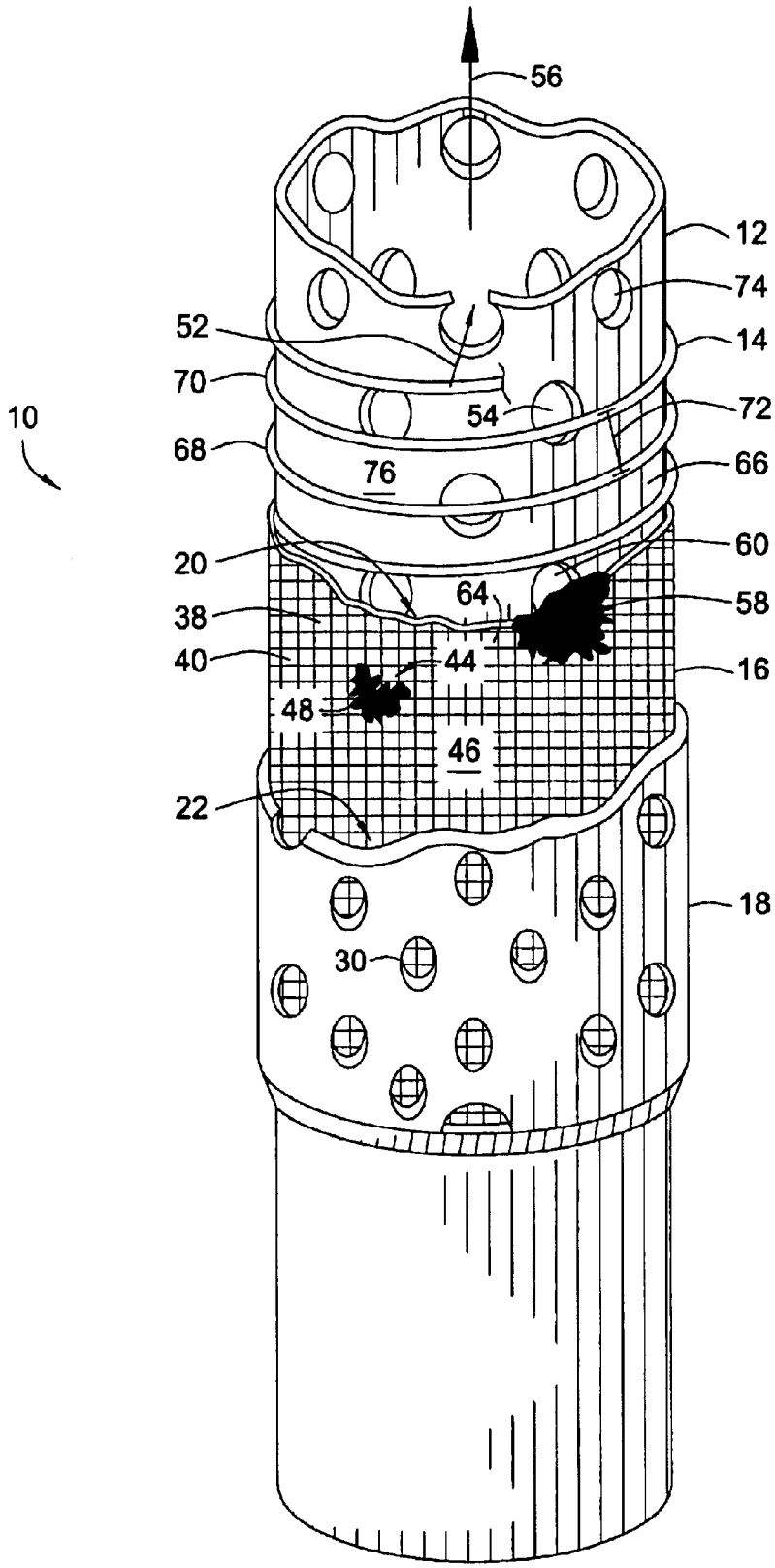
FIG. 2 is a perspective view of the portion of the well screen of FIG. 1 assembled.
Figure 3:
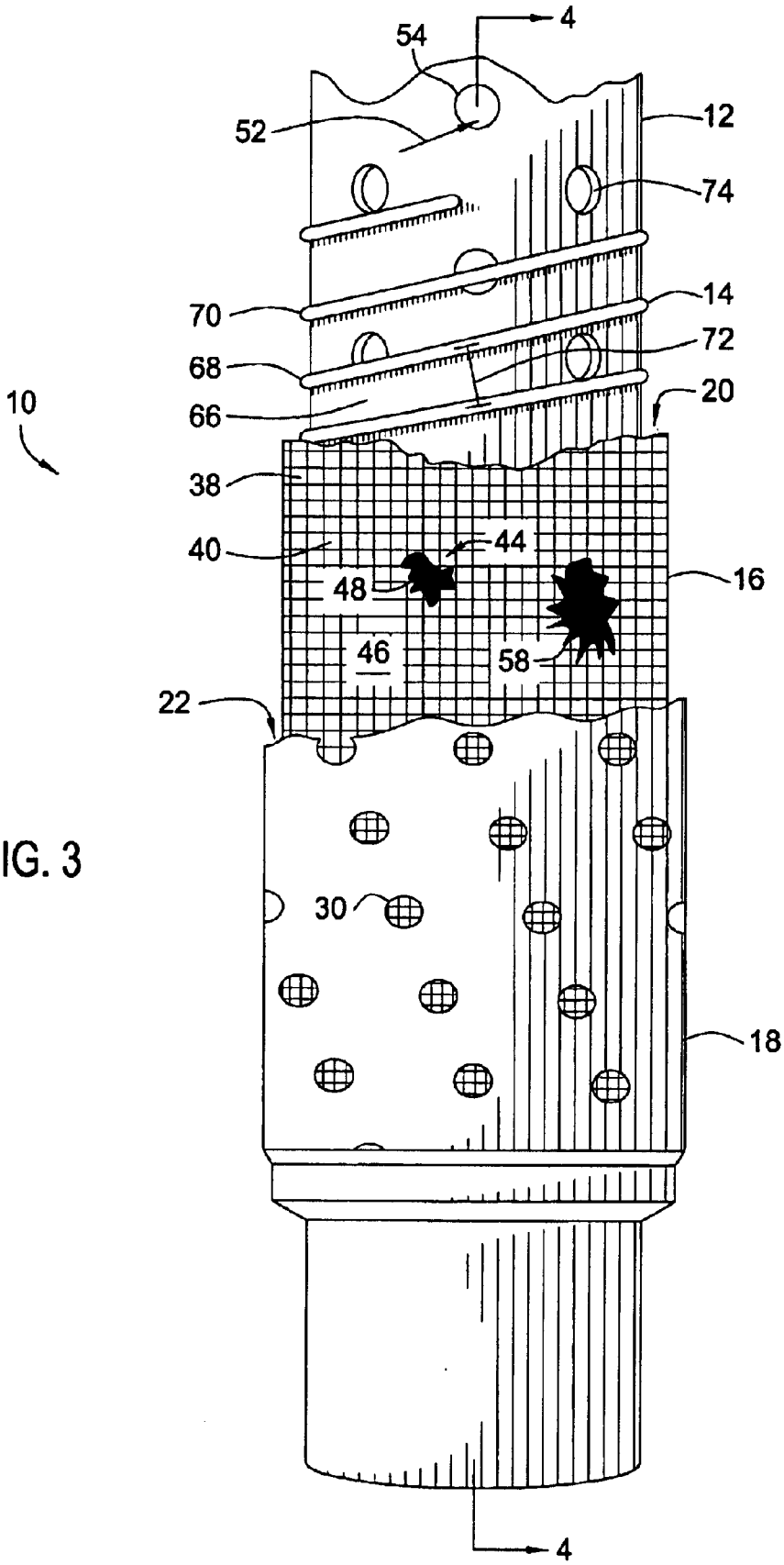
FIG. 3 is a side view of the portion of the well screen of FIG. 1 assembled.

The wire-mesh screen 16 constitutes a relatively fine lattice of thin wires 38 woven together with interstitial spaces 40 between them. The interstitial spaces 40 are sized to prevent particles of a predetermined size from passing through the wire-mesh screen 16. In this way, as oil flows into the first annular space 20 along a flow path 42, it flows through wire-mesh screen 16 which filters a certain percentage of sand (or other undesirable particulate matter) from it. As can be seen in FIGS. 2 and 3, particles of sand 44 which are too large to fit through the interstitial spaces 40 get lodged on a surface 46 of the wire-mesh screen 16 and clog a portion 48 of the wire-mesh screen 16. Those particles of sand which lodge on the surface 46 of the wire-mesh screen 16 clog a portion of the wire-mesh screen 16 and render that portion useless for filtering purposes.

After oil has entered the first annular space 20, it continues along a flow path 50 through interior passageways 52 defined by base pipe perforations or apertures 54. Once oil has passed through interior passageways 52, it collects in a main passage 56 defined by the perforated base pipe 12. From there, the oil is carried by the main passage 56 up and out of the well bore.

If the wire-mesh screen 16 were wrapped directly against the perforated base pipe 12 (a configuration not shown), and a large enough portion of the surface 46 of the wire-mesh screen 16 became clogged with sand 58, a base pipe perforation 60 (FIG. 2) positioned directly radially inward of the clog 58 would be useless. Put another way, if the wire-mesh screen 16 were placed directly against the perforated base pipe 12, a large enough sand clog 58 would prevent all flow through the base pipe perforation 60 radially inward of the clog 58. However, referring to FIG. 2, the spirally-wrapped wire 14 allows oil flowing through an unclogged portion 64 of the wire-mesh screen 16 to subsequently flow under the clog 58 and through the base pipe perforation 60, even though the base pipe perforation 60 is not directly radially inward of the unclogged portion 64. In other words, after oil flows through the wire-mesh screen 16, it may flow through any one of the base pipe perforations 54, and not just a base pipe perforation directly radially inward of that portion of the wire-mesh screen through which the oil flowed.

In this way, the spirally-wrapped wire 14 spaces the wire-mesh screen 16 from the perforated base pipe 12 and creates a single, spiral channel 66 around the base pipe 12. The spiral channel 66 connects together all of the base pipe perforations 54 so that oil flowing through a particular portion of the wire-mesh screen 16 may subsequently flow through any base pipe perforation. This helps prevent an increased flow rate through any one base pipe perforation 54, which can cause an increased rate of erosion in that portion of the wire-mesh screen 16 adjacent to the base pipe perforation 54. Additionally, the spirally-wrapped wire 14 sufficiently spaces the wire-mesh screen 16 from the perforated base pipe 12 so that very fine sand particles ricocheting off a surface 76 of base pipe 12 after having passed through the wire-mesh screen 16 do not abrade and erode the wire-mesh screen 16.

Referring to FIGS. 2 and 3, the consecutive revolutions 68 and 70 of spirally-wrapped wire 14 are spaced approximately ⅜ of an inch apart to create the approximately ⅜ of an inch wide channel 66. The channel 66 has a channel width 72 which is slightly less than an aperture diameter 74 of the base pipe perforations 54. However, it will be readily apparent to one of ordinary skill in the art that the width 72 of the channel 66 and diameter 74 of the perforations 54 may be varied.

In addition to spacing the wire-mesh screen 16 from the perforated base pipe 12, thereby creating the flow channel 66, the spirally-wrapped wire 14 also provides support for the wire-mesh screen 16. When oil flows through the well screen 10, significant pressure is exerted on the wire-mesh screen 16. This pressure causes the wire-mesh screen 16 to deform. If the consecutive revolutions or turns 68 and 70 of the spirally-wrapped wire 14 are too far apart, the wire-mesh screen 16 can deform to a point were it directly contacts the perforated base pipe 12. As described above, if the portion of the wire-mesh screen 16 that comes in contact with the perforated base pipe 12 is clogged, it can completely obstruct a base pipe perforation 54 with which it comes in contact. With the consecutive revolutions 68 and 70 spaced as shown in FIGS. 1 through 4, the spirally-wrapped wire 14 provides support for the wire-mesh screen 16 in both a longitudinal direction and a lateral direction.

Although the invention has been described in detail with reference to certain preferred embodiments, variations and modifications exist within the scope and spirit of the invention as described and defined in the following claims.

I claim:

1. A well screen comprising:

a cylindrical, perforated, base pipe defining a pipe longitudinal axis and an exterior surface, a woven wire mesh filtering medium substantially surrounding, and in a spaced-apart relationship with, the exterior surface of the base pipe, the filtering medium defining a filtering medium longitudinal axis, which is substantially collinear with the pipe longitudinal axis, thereby forming an annular space between the exterior surface of the base pipe and the filtering medium, an elongated rib coupled to the exterior surface of the base pipe and positioned in the annular space, the elongated rib extending substantially parallel to the pipe longitudinal axis, and a wire having a thickness, the wire positioned within the annular space and spirally extending around the exterior surface of the base pipe and the elongated rib coupled to the exterior surface of the base pipe, thereby creating consecutive revolutions of wire longitudinally spaced along the elongated rib and the exterior surface of the base pipe, the consecutive revolutions of wire creating a corresponding gap between the consecutive revolutions of wire, the gap having a width greater than the thickness of the wire.

2. The well screen of claim 1, wherein the gap is less than one inch wide.

3. The well screen of claim 1, wherein the perforated base pipe includes an aperture, the aperture being wider than the gap.

4. The well screen of claim 1, wherein the gap is greater than ⅛ of an inch wide.

5. The well screen of claim 1, further comprising a perforated jacket surrounding the filtering medium.

6. A well screen comprising:

a perforated base pipe, a filter medium surrounding, and in a spaced-apart relationship with, the base pipe, said filter medium being substantially concentric with the base pipe, thereby forming an annular space between the base pipe and the filter medium; and a wire matrix disposed along the exterior surface of the base pipe and positioned in the annular space, the wire matrix configured to have a flow-through area substantially greater than the flow through area of the surrounding filter medium; and the wire matrix having wire members oriented substantially parallel to the longitudinal axis of the base pipe, and wire members oriented substantially perpendicular to the longitudinal axis of the base pipe so as to provide both longitudinal and radial support for the surrounding filter medium.

* * * * *